US009976352B2

(12) United States Patent
Fraser et al.

(10) Patent No.: US 9,976,352 B2
(45) Date of Patent: May 22, 2018

(54) ROCK FORMATION DRILL BIT ASSEMBLY WITH ELECTRODES

(71) Applicants: Aramco Overseas Company, B.V., The Hague (NL); Geoprober Ltd., Aberdeen (GB)

(72) Inventors: Scott Fraser, Aberdeenshire (GB); Ben Bamford, Aberdeen (GB)

(73) Assignee: Saudi Arabian Oil Company, Dhahran (SA)

( * ) Notice: Subject to any disclaimer, the term of this patent is extended or adjusted under 35 U.S.C. 154(b) by 235 days.

(21) Appl. No.: 14/838,021

(22) Filed: Aug. 27, 2015

(65) Prior Publication Data

US 2017/0058608 A1 Mar. 2, 2017

(51) Int. Cl.

| | |
|---|---|
| ***E21B 10/04*** | (2006.01) |
| ***E21B 7/15*** | (2006.01) |
| ***E21B 10/42*** | (2006.01) |
| ***E21C 37/16*** | (2006.01) |

(52) U.S. Cl.

CPC ..... *E21B 7/15* (2013.01); *E21B 10/04* (2013.01); *E21B 10/42* (2013.01); *E21C 37/16* (2013.01)

(58) Field of Classification Search

CPC . E21B 7/15; E21B 10/04; E21B 10/42; E21B 10/60; E21C 37/16

USPC ..... 175/16

See application file for complete search history.

(56) References Cited

U.S. PATENT DOCUMENTS

| | | | | |
|---|---|---|---|---|
| 6,006,844 | A | 12/1999 | Van Puymbroeck | |
| 6,164,388 | A | 12/2000 | Martunovich | |
| 7,270,195 | B2 | 9/2007 | MacGregor et al. | |
| 7,416,032 | B2 | 8/2008 | Moeny et al. | |
| 2012/0012392 | A1* | 1/2012 | Kumar | E21B 25/00 175/58 |
| 2013/0032406 | A1* | 2/2013 | Comeaux | E21B 7/001 175/57 |
| 2014/0027178 | A1 | 1/2014 | Jeffryes | |

OTHER PUBLICATIONS

International Search Report and Written Opinion of the International Searching Authority issued in international Application No. PCT/IB2016/001323 dated Dec. 20, 2016; 12 pages.

* cited by examiner

*Primary Examiner* — David J Bagnell
*Assistant Examiner* — Yanick A Akaragwe
(74) *Attorney, Agent, or Firm* — Fish & Richardson P.C.

(57) ABSTRACT

A rock formation drill bit assembly with electrodes includes a drill bit including a hollow portion that extends along a longitudinal axis of the drill bit. The hollow portion extends from a first end to a second end opposing the first end. Cutters as positioned on the first end. The cutters are configured to cut the rock formation resulting in a rock core protruding from the rock formation into the hollow portion. The rock core includes a circumferential surface. Multiple electrodes are positioned within an inner circumferential surface of the hollow portion. The multiple electrodes are configured to apply electrical discharge across multiple locations on the circumferential surface of the rock core. The electrical discharge causes the rock core to fracture.

27 Claims, 8 Drawing Sheets

ROCK FORMATION DRILL BIT ASSEMBLY WITH ELECTRODES

TECHNICAL FIELD

This specification relates to fracturing rock formations, for example, using a drill bit assembly.

BACKGROUND

Drill bit assemblies are used to drill through rock formations, for example, to fracture the formations or to obtain access to portions of the formations. Drill bit assemblies are also used to form wellbores from a surface into a rock formation holding trapped hydrocarbons (for example, oil, gas, or combinations of them).

SUMMARY

This specification describes technologies relating to a rock formation drill bit assembly with electrodes.

Certain aspects of the subject matter described here can be implemented as a method. A rock formation is cut using cutters on a first end of a drill bit. The drill bit includes a hollow portion that extends along a longitudinal axis of the drill bit from the first end towards a second end opposing the first end. A rock core protrudes from the rock formation into the hollow portion in response to the cutting. The rock core includes a circumferential surface. Electrical discharge is applied across multiple locations on the circumferential surface of the rock core to fracture the rock core.

This, and other aspects, can include one or more of the following features. Multiple electrodes can be attached at respective locations on an inner circumferential surface of the drill bit. Applying the electrical discharge can include applying the electrical discharge across at least two of the multiple electrodes. The multiple electrodes can include a first electrode and a second electrode arranged on the inner circumferential surface of the drill bit. The electrical discharge can be applied between the first electrode and the second electrode. The first electrode and the second electrode can be arranged diametrically opposite each other on opposing sides of the circumferential surface of the rock core. The multiple electrodes can include a third electrode and a fourth electrode arranged on the inner circumferential surface of the drill bit. The electrical discharge can be applied between the third electrode and the fourth electrode. The first, second, third and fourth electrodes can be arranged on the same circumferential plane. A timing of the electrical discharge between the first electrode and the second electrode and the electrical discharge between the third electrode and the fourth electrode can be controlled. The timing can be controlled to apply the electrical discharge between the first electrode and the second electrode and the electrical discharge between the third electrode and the fourth electrode at different times. The first electrode and the second electrode can be arranged on a first circumferential plane. The multiple electrodes can include a fifth electrode and a sixth electrode arranged on a second circumferential plane on the inner circumferential surface of the drill bit. The second circumferential plane can be separate from the first circumferential plane along the longitudinal axis of the drill bit. The circumferential surface of the rock core can contact discharging tips of the multiple electrodes. At least a portion of the fractured rock core can be removed from within the hollow portion through an aperture formed in the drill bit. At least a portion of drilling mud can be flowed through the hollow portion to remove at least the portion of the fractured rock core through the aperture. At least the portion of the drilling mud can be flowed through a drilling mud nozzle positioned in the hollow portion at a location that is diametrically opposite a location of the aperture. A height of the rock core inside the hollow portion can be controlled using cutters attached to a circumferential end surface of the hollow portion. An application of the electrical discharge across the two locations on the circumferential surface of the rock core can be controlled based, in part, on a weight on the drill bit.

Certain aspects of the subject matter described here can be implemented as a drill bit assembly to cut a rock formation. The drill bit assembly includes a drill bit including a hollow portion that extends along a longitudinal axis of the drill bit. The hollow portion extends from a first end to a second end opposing the first end. Cutters as positioned on the first end. The cutters are configured to cut the rock formation resulting in a rock core protruding from the rock formation into the hollow portion. The rock core includes a circumferential surface. Multiple electrodes are positioned within an inner circumferential surface of the hollow portion. The multiple electrodes are configured to apply electrical discharge across multiple locations on the circumferential surface of the rock core. The electrical discharge causes the rock core to fracture.

This, and other aspects, can include one or more of the following features. The multiple electrodes can include a first electrode and a second electrode arranged on the inner circumferential surface of the drill bit. The electrical discharge can be applied between the first electrode and the second electrode. The first electrode and the second electrode can be arranged diametrically opposite each other on opposing sides of the circumferential surface of the rock core. The multiple electrodes can include a third electrode and a fourth electrode arranged on the inner circumferential surface of the drill bit. The electrical discharge can be applied between the third electrode and the fourth electrode. The first, second, third and fourth electrodes can be arranged on the same circumferential plane. A controller including processing circuitry can be configured to control a timing of the electrical discharge between the first electrode and the second electrode and the electrical discharge between the third electrode and the fourth electrode. The controller can be configured to control the timing to apply the electrical discharge between the first electrode and the second electrode and the electrical discharge between the third electrode and the fourth electrode at different times. The first electrode and the second electrode can be arranged on a first circumferential plane. The multiple electrodes can include a fifth electrode and a sixth electrode arranged on a second circumferential plane on the inner circumferential surface of the drill bit. The second circumferential plane can be separate from the first circumferential plane along the longitudinal axis of the drill bit. The circumferential surface of the rock core can contact discharging tips of the pair of electrodes. An aperture can be formed on a circumferential surface of the drill bit. A drilling mud nozzle can be included in the hollow portion. The drilling mud nozzle can flow drilling mud into the hollow portion to remove at least a portion of the fractured rock core from within the hollow portion. The drilling mud nozzle can be attached to an inner circumferential surface of the hollow portion at a location that is diametrically opposite a location of the aperture. An insert can be positioned within and attached to the hollow portion. The multiple electrodes can be attached to the insert. The insert can be a ceramic insert. The insert can include a slot that aligns with the hollow portion on the drill bit. The cutters can include first cutters. The drill bit assembly can include second cutters positioned inside the hollow portion and attached to a circumferential end surface of the hollow portion.

The details of one or more implementations of the subject matter described in this specification are set forth in the accompanying drawings and the description below. Other features, aspects, and advantages of the subject matter will become apparent from the description, the drawings, and the claims.

DETAILED DESCRIPTION

This specification describes a rock formation drill bit assembly with electrodes, for example, electrical plasma discharge electrodes. Plasma channel drilling (PCD) is a process by which high voltage pulses are used to cause electrical breakdown of the formation. The subsequent localized heating and expansion causes fracture of the rock allowing material to be removed from the main mass of rock. Rock formations can be damaged (that is, fractured) in this manner using PCD alone or using a combination of PCD and mechanical cutters.

This specification describes a hybrid rotary-plasma drill bit assembly in which both rotary action and high voltage plasma discharges are used to fracture and drill ahead in a rock formation, for example, sandstone, limestone, granite, or other rock formation. As described below, multiple electrodes are arranged in the drill bit assembly to pulse electricity through opposite sides of a rock core that protrudes from the rock formation instead of along a top or bottom surface of the rock core. The arrangement of electrodes described here can result in more efficient destruction of the rock and creation of larger cuttings allowing a faster rate of drilling. The destruction techniques described here rely upon tensile failure of the rock formation rather than compressive failure, thereby maximizing the efficiency of the wellbore construction process by taking advantage of natural phenomena. The drill bit assembly described here additionally includes features (described later) that allow efficient removal of the cuttings created by the electrodes, thereby allowing the realization of benefits of PCD. Using the drill bit assembly described here can increase rate of penetration (ROP) in hard rock formations. One example implementation of the drill bit assembly is described with reference to wellbore drilling. The drill bit assembly can be used to drill rock formations in other applications, for example, drilling in hard rock in deep wells where hard rock is encountered.

Figure 1:
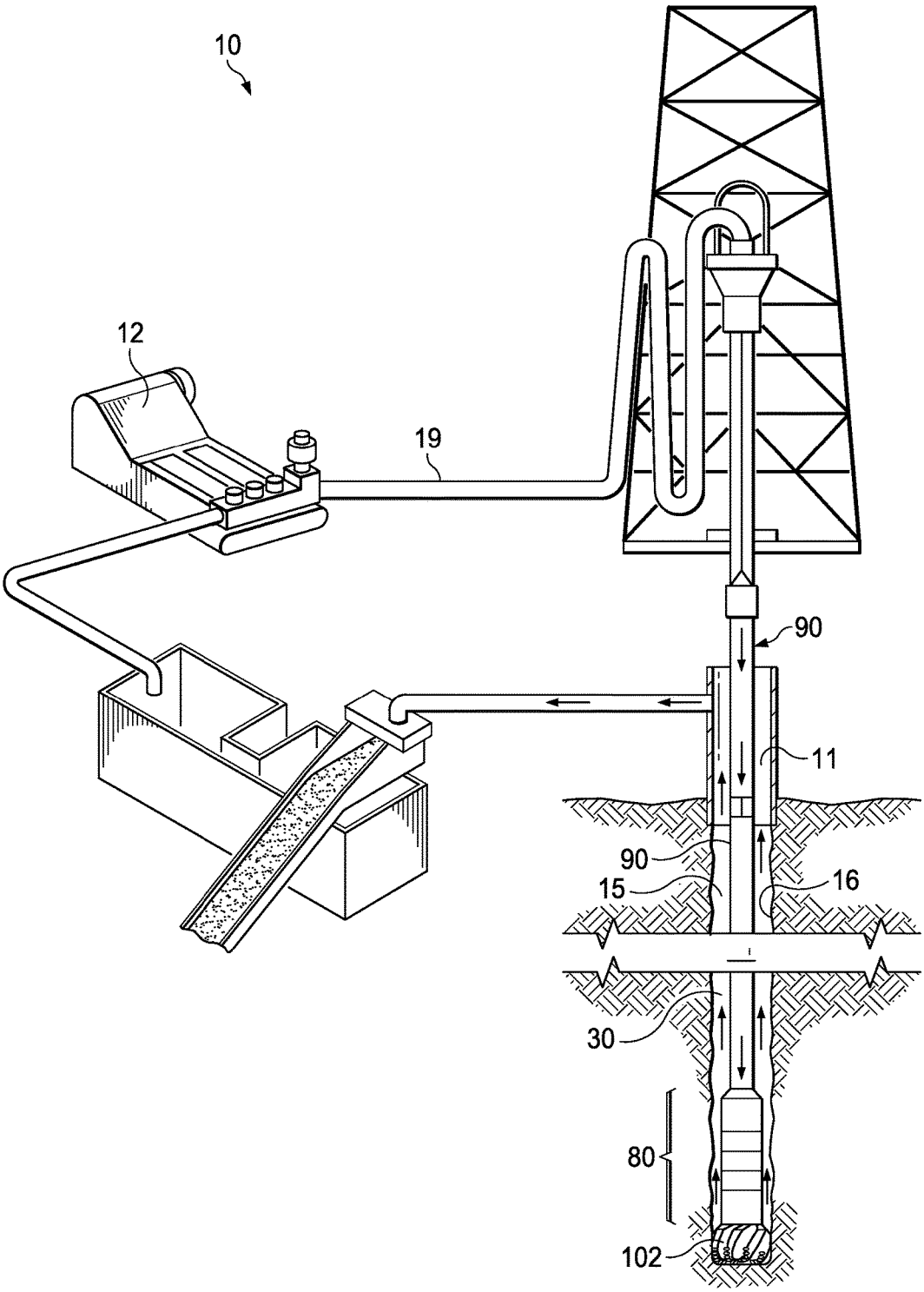
FIG. 1 illustrates a schematic diagram of a drilling rig engaged in drilling operations on a wellbore.

FIG. 1 illustrates a schematic diagram of a drilling rig 10 engaged in drilling operations on a wellbore 11. The drilling rig 10 may be powered by mechanical, electrical, hydraulic, pneumatic and other forms of energy source. The drilling rig 10 may use cable, metal drill pipe, plastic drill pipe, or coil tubing to raise and drop a drill bit assembly 102 for drilling. In the example shown in FIG. 1, a pump 12 circulates drilling fluid 30 (also referred to in the art as drilling mud) through the drill string 90 down through the bottom hole assembly 80, through the drill bit assembly 102 and back to the surface through the annulus 15 between the drill string 90 and the borehole wall 16.

Figure 2A:
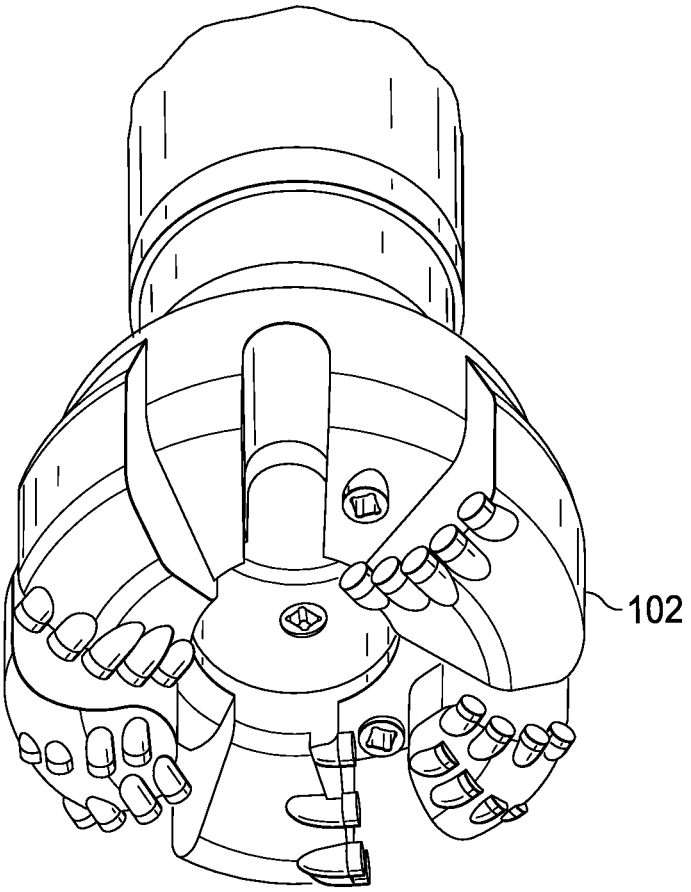
FIGS. 2A and 2B are schematic diagrams of an example of a drill bit assembly used to drill a rock formation and the interaction with that formation.
Figure 2B:
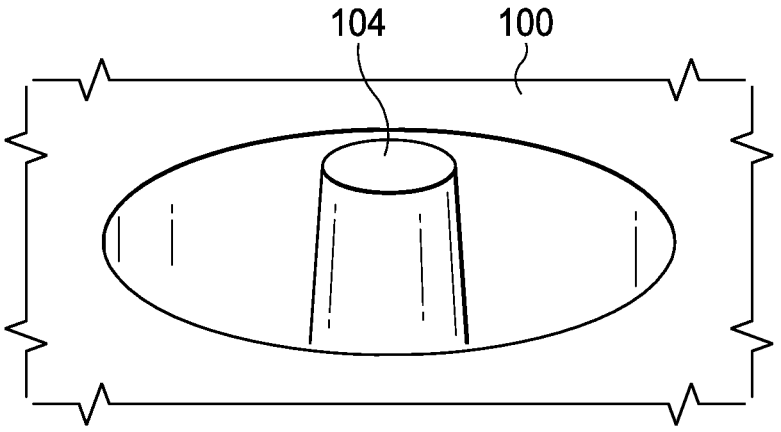

FIGS. 2A and 2B are schematic diagrams of an example of a drill bit assembly 102 used to drill a rock formation 100. In some implementations, the drill bit assembly 102 includes a hybrid rotary-plasma drill bit in which both rotary action and high voltage plasma discharges are used to fracture the rock formation 100. As described below, the drill bit assembly 102 includes a hollow portion that includes cutters. The cutters cut portions of the rock formation 100 as the drill bit assembly 102 rotates. The rotary action results in the formation of a rock core 104 that protrudes from the rock formation 100 into the hollow portion of the drill bit assembly 102. High voltage electrodes, positioned within the hollow portion, apply electrical discharge on opposing sides of the rock core 104 to fracture the rock core 104. In this manner, the combined rotary cutting action on the rock formation 100 around a periphery of the rock core 104 combined with plasma channel drilling using the electrodes can cause destruction of the rock formation 100 and removal of the core 104. The rock core area is removed via electrical shock wave and plasma channel energy expansion while the surrounding rock matrix is removed by rotating cutters.

Figure 3A:
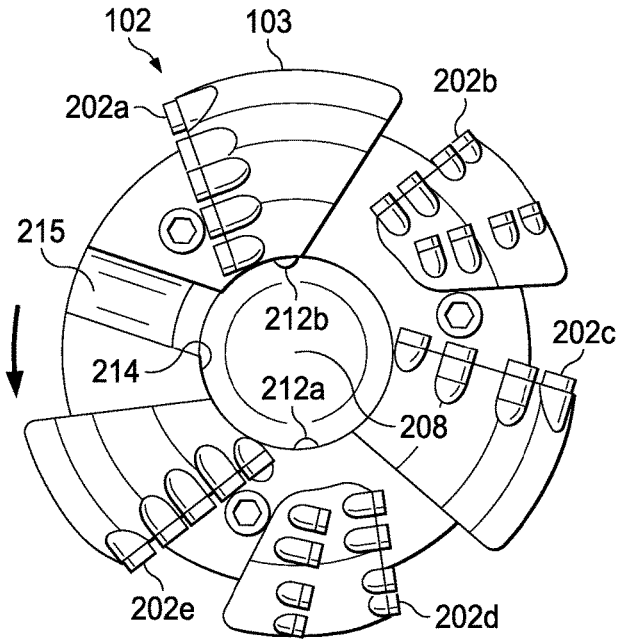
FIGS. 3A, 3B and 3C are schematic diagrams of a front view, side view and a perspective view, respectively, of a drill bit assembly.
Figure 3B:
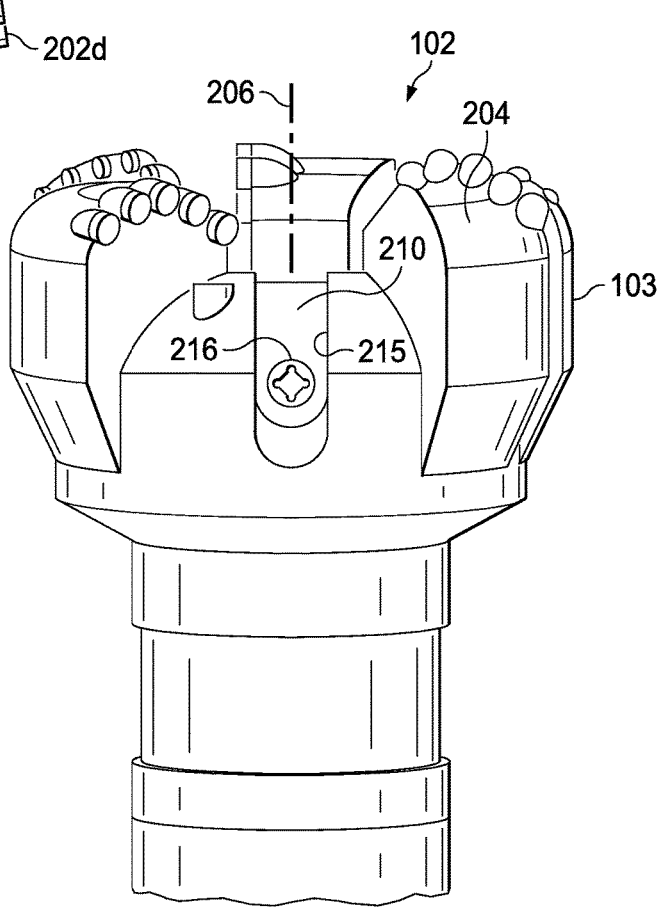
Figure 3C:
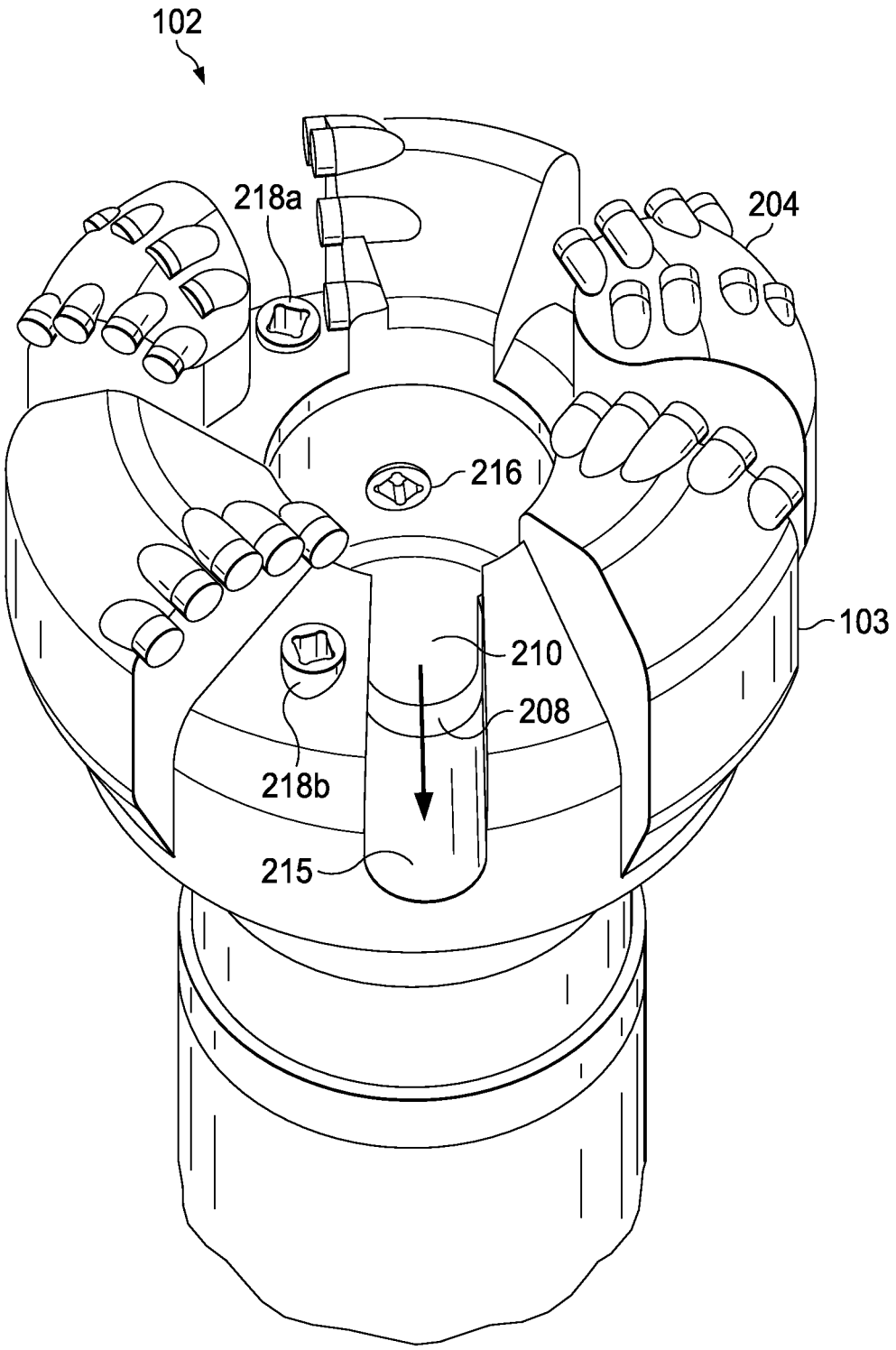

FIGS. 3A, 3B and 3C are schematic diagrams of a front view, side view and a perspective view, respectively, of a drill bit assembly, for example, the drill bit assembly 102. The drill bit assembly 102 includes a drill bit 103, for example, a wellbore drill bit or a drill bit for drilling rock formations. The drill bit 103 includes a hollow portion 210 that extends along a longitudinal axis 206 of the drill bit 103. The hollow portion 210 extends from a first end 204 of the drill bit 103 to a second end 208 opposing the first end 204. The hollow portion 210 can be substantially cylindrical. The drill bit assembly 102 includes cutters (for example, a first cutter 202*a*, a second cutter 202*b*, a third cutter 202*c*, a fourth cutter 202*d*, or more or fewer cutters) positioned on the first end 204. The cutters can cut the rock formation, for example, the rock formation 100, resulting in a rock core, for example, the rock core 104, protruding from the rock formation into the hollow portion 210. The cutters of the drill bit assembly 102 can be any cutter used to drill a rock formation or a wellbore (or both). A rotary action of the drill bit assembly 102 on the rock formation 100 can cause the cutters to cut portions of the rock formation 100 resulting in a substantially cylindrical rock core 104 protruding through the hollow portion 210.

Figure 4:
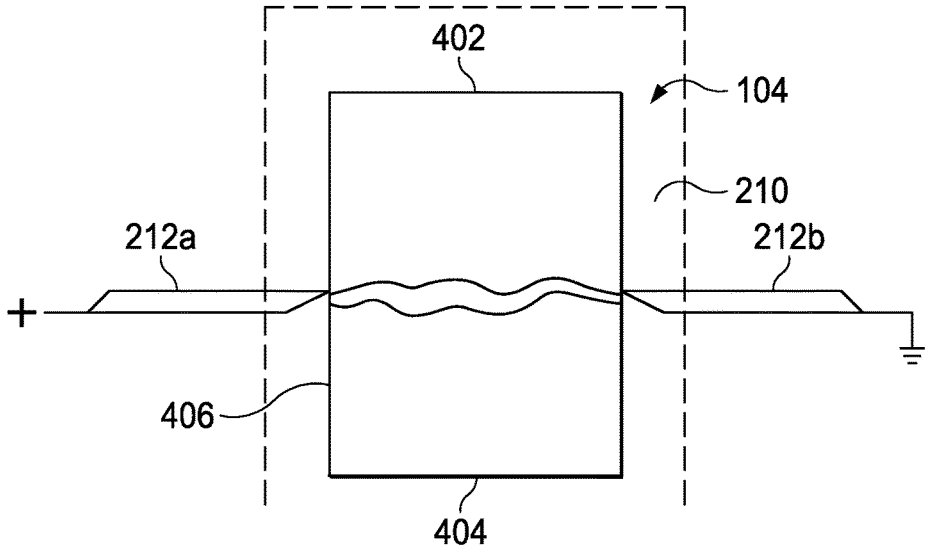
FIG. 4 is a schematic diagram of multiple electrodes applying electrical discharge to a rock core.

The drill bit assembly 103 can include multiple electrodes (for example, a first electrode 212*a*, a second electrode 212*b*) positioned within an inner circumferential surface 214 of the hollow portion 210. For example, the first electrode 212*a* and the second electrode 212*b* can be positioned on the same circumferential plane, that is, a plane perpendicular to the longitudinal axis 106. The multiple electrodes can apply electrical discharge across multiple locations on a circumferential surface of the rock core to fracture the rock core. FIG. 4 is a schematic diagram of multiple electrodes (for example, the first electrode 212*a*, the second electrode 212*b*) applying electrical discharge to a rock core, for example, the rock core 104. As described above, the rock core 104 is formed when a rotary motion of the drill bit 103 cuts the rock formation 100, specifically, the peripheral matrix rock surrounding the rock core 104. The resulting rock core 104 protrudes into the hollow portion 210 of the drill bit assembly 102.

The rock core 104 includes end surfaces 402 and 404, and a circumferential surface 406. The multiple electrodes can be positioned to apply the electrical discharge on the circumferential surface 406 such that the high voltage passes across the body of the rock core 104 instead of across a surface. Experiments demonstrated that applying the electrical discharge across the body of the rock core 104 increased the efficiency of fracture significantly compared to applying the electrical discharge across the surface. One of the electrodes can be grounded while a positive charge is applied to another. In some implementations, the multiple electrodes can be positioned within the hollow portion 210 such that the circumferential surface 406 of the rock core 104 contacts discharging tips of the electrodes. In some implementations, the multiple electrodes can be positioned such that the discharging tips are a distance away, for example, less than 1 millimeter, from the circumferential surface 406. A distance between the circumferential surface 406 of the rock core 104 and the discharging tips of the electrode can depend on the fluid type in which the drill bit assembly 102 is used. For example, if the fluid has good dielectric properties, for example, the fluid is an insulator, then the preferred path for the electric discharge would be through the rock, and the offset distance can be high (for example, greater than 1 mm). Conversely, if the fluid is conductive where the path from one electrode to the other needs to be more directly addressed through the rock, then the offset distance can be small or there can be no offset distance. In operation, after the rock core 104 is formed in the hollow portion 210 due to the rotary action of the drill bit 102 on the rock formation 100, the multiple electrodes discharge high voltage electricity across the circumference of the rock core 104 to fracture the rock core.

The drill bit assembly 102 includes an aperture 215 (for example, a window) formed on a circumferential surface of the drill bit 103. For example, the aperture 215 extends from the first end 204 of the drill bit 103 part-way toward the second end 208. That is, the aperture 215 need not span the entire distance between the first end 204 and the second 208. The aperture 215 can be formed in a direction that is perpendicular to the direction of drilling. The fractured rock core can be removed from the hollow portion 210 through the aperture 215.

The drill bit assembly 102 further includes a drilling mud nozzle 216 in the hollow portion 210. The drilling mud nozzle 216 flows drilling mud into the hollow portion 210 to remove at least a portion of the fractured rock core from within the hollow portion 210. In some implementations, the drilling mud nozzle 216 can be positioned in the inner circumferential surface of the drilling bit assembly 102. The nozzle 216 can be located diametrically opposite the aperture 215 to flow the fractured rock core out of the hollow portion 210 through the aperture 215. In addition, as shown in FIG. 3B, a distance between the nozzle 216 and the first end 204 of the drill bit 103 can be less than a length of the aperture 215 such that the nozzle 216 is visible when the drill bit 103 is viewed horizontally through the aperture 215. In this position, a horizontal jet or stream of drilling mud through the nozzle 216 can flow the fractured rock core out of the hollow portion 210.

Figure 5A:
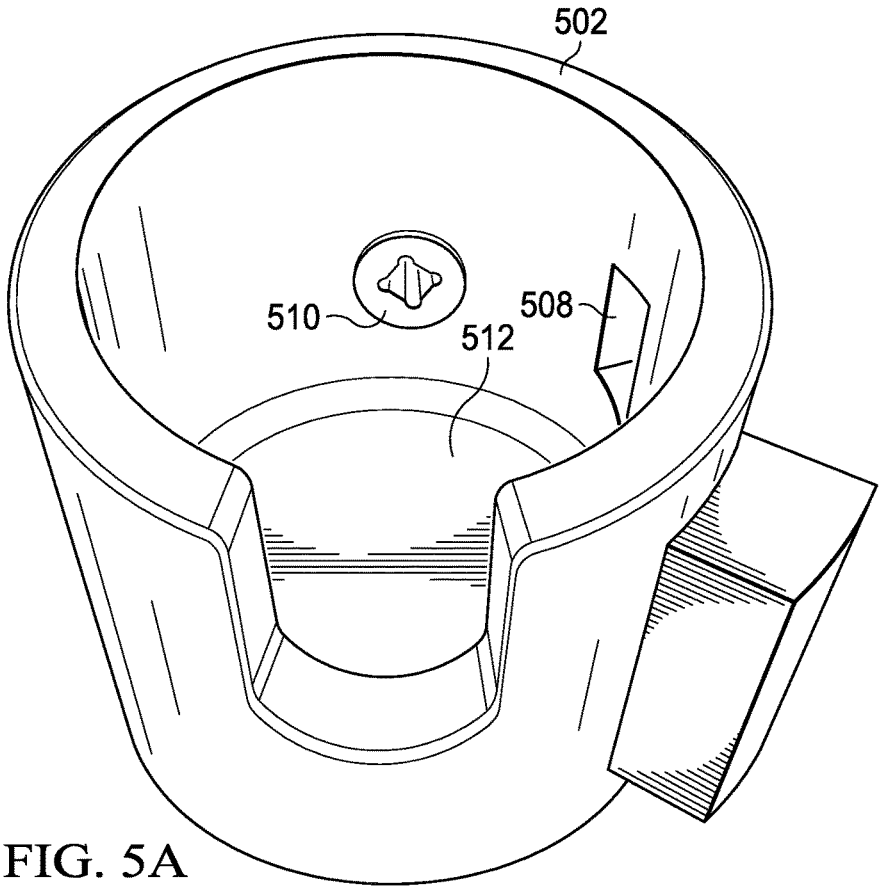
FIG. 5A is a schematic diagram of an insert to be positioned within the drill bit assembly.

In some implementations, the multiple electrodes can be mounted to an insert, which can then be positioned within the drill bit assembly 102. FIG. 5A is a schematic diagram of such an insert 502. The insert 502 can include a key to locate the insert 502 into the hollow portion 210 of the drill bit assembly 210. A nozzle outlet portion 510 can be formed on the inside surface of the insert 502. When the insert 502 is positioned within the hollow portion 210, the nozzle outlet portion 510 can be aligned with the nozzle 216 to allow flow of the drilling mud to clear the fractured rock core from within the drill bit 103. The insert 502 can also include an aperture 512 which can align with the aperture 215 when the insert 502 is positioned within the hollow portion 210. FIG. 5A also shows an electrode 508 positioned within the insert.

The insert 502 can be made of an insulating material that can withstand drilling conditions. In particular, the insulating material can be selected to have high toughness and dielectric strength to provide electrical insulation between the high voltage and ground electrodes, and between the high voltage electrodes and the main body of the drill bit. For example, the insert 502 can be made of a ceramic such as silicon nitride or titanium dioxide or other material.

Figure 5B:
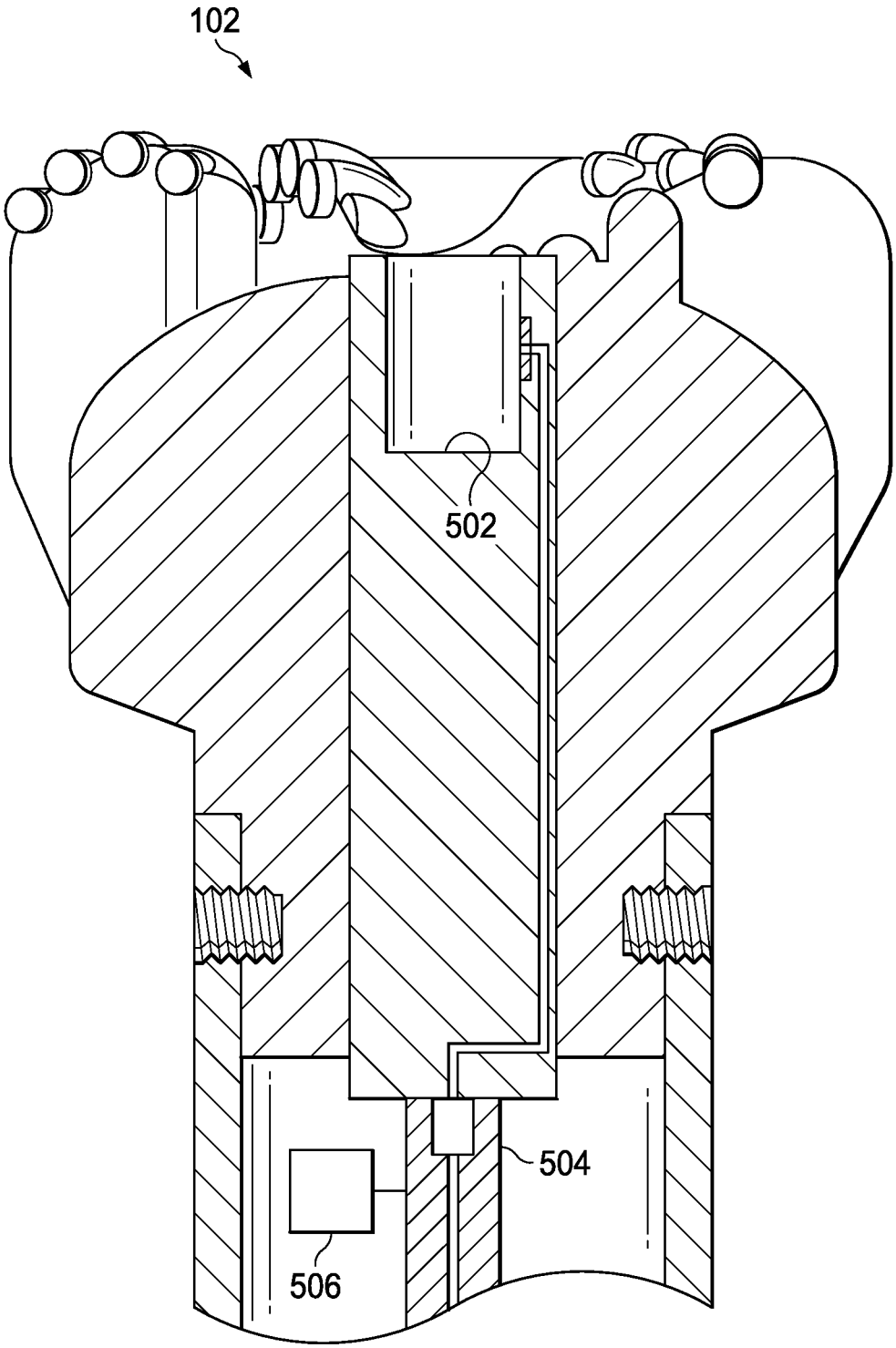
FIG. 5B is a side cutaway of a schematic diagram of the drill bit assembly.

FIG. 5B is a side cutaway of a schematic diagram of the drill bit assembly 102. FIG. 5B shows a connection of the multiple electrodes positioned in the insert 502 to a pulse channel drilling pulse generator 504 that can generate one or more electrical discharge pulses to be transmitted across the rock core 104. The pulse generator 504 can include or be connected to a voltage regulator or a voltage generator or both. The pulse generator 504, the voltage regulator, and the voltage generator can be implemented as a single unit or as separate units positioned at different locations. The pulse generator 504 can supply power to the high voltage electrode. The pulse generator 504 can be insulated in the same manner as the electrode itself to prevent inadvertent arcing within the bit assembly. The pulse generator 504 can be positioned at a location away from the drill bit assembly, for example, the surface. In such implementations, downhole cables can transmit power from the pulse generator 504 to the electrodes in the drill bit assembly 102.

As shown in FIG. 5B, the drill bit assembly 102 can be assembled by threadedly connecting (for example, by fastening using a screw or otherwise) onto a connection and fitting the insert 502 from the inside using the key to secure the insert 502 laterally. Alternatively, the drill bit can be pinned in place instead of using a threaded connection allowing the insert 502 and electrodes to be installed in the drill bit before the drill bit is attached to the pulse generator section. The negative electrode can either be connected in the same manner as the high voltage electrode or using the earthed body of the bit as the conductor.

In some implementations, a controller 506 can be connected to the pulse generator 504. The controller 506 can include processing circuitry or a computer-readable medium storing instructions executable by one or more processors or a combination of them. The controller 506 can be configured to control the pulse generator 504 to output one pulse or a sequence of pulses at controllable frequencies to the electrodes positioned in the insert 502. In some implementations, the controller 506 can be configured to control a timing of electrode discharge, as described below. In the example implementation shown in FIG. 5B, the controller 506 is positioned in the drill bit assembly 102. Alternatively, the controller 506 can be positioned at a location away from the drill bit assembly, for example, the surface or apparatus in line with the drilling assembly. In such implementations, downhole cables can transmit control signals from the controller 506 to the pulse generator 504.

The controller 506 can cause the pulse generator 504 to apply a high voltage pulse or set of pulses with high frequency between the electrodes causing electrical breakdown across the rock core (plasma channel dielectric breakdown). The electrical breakdown can cause a change in the dielectric rock properties causing the electrical resistance of the rock core to drop and allowing a current (for example, of the order of kiloamperes) to pass through the rock core. The current discharge can cause localized heating of the rock with the consequent thermal expansion resulting in fractures and rock matrix failure. In this manner, plasma channels created across the rock core can allow removal of a large volume of the rock using a single electrical pulse compared to if both electrodes were on the same surface of the rock.

Figure 6:
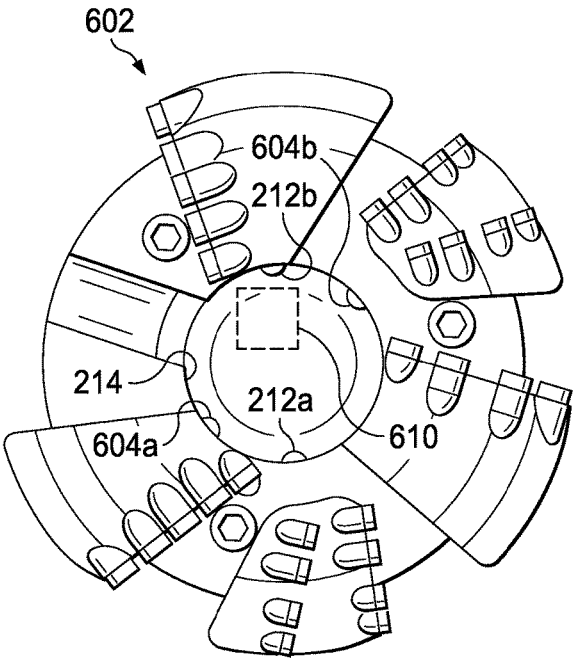
FIG. 6 is a schematic diagram of a drill bit assembly including multiple electrodes positioned on the same circumferential plane.

In some of the implementations described above, the drill bit assembly 102 included two electrodes positioned on the same circumferential plane, that is, a plane perpendicular to the longitudinal axis 206. In some implementations, the drill bit assembly 102 can include more than two electrodes. FIG. 6 is a schematic diagram of a drill bit assembly 602 including more than two electrodes positioned on the same circumferential plane. The drill bit assembly 602 includes four electrodes (for example, a first electrode 212*a*, a second electrode 212*b*, a third electrode 604*a*, a fourth electrode 604*b*) positioned on the same circumferential plane and on the inner circumferential surface 214 of the hollow portion of the drill bit. The four electrodes can be equidistantly positioned on the circumferential plane. Alternatively, the first electrode 212*a* and the second electrode 212*b* are diametrically opposite each other, and the third electrode 604*a* and the fourth electrode 604*b* are diametrically opposite each other. The drill bit assembly 602 can include a controller 610 that can control a timing of electrical discharge of the four electrodes. In some implementations, the controller 610 can control a pulse generator (such as the pulse generator 504) to cause the four electrodes to sequentially discharge high voltage electricity either in a clockwise or anti-clockwise direction. For example, the controller 610 can be in a pulse rectifier unit behind the drill bit assembly 602 in a separate assembly. In some implementations, the drill bit assembly 602 can include more than four electrodes based on a geometry of the hollow portion and available space to ensure adequate insulation.

Figure 7:
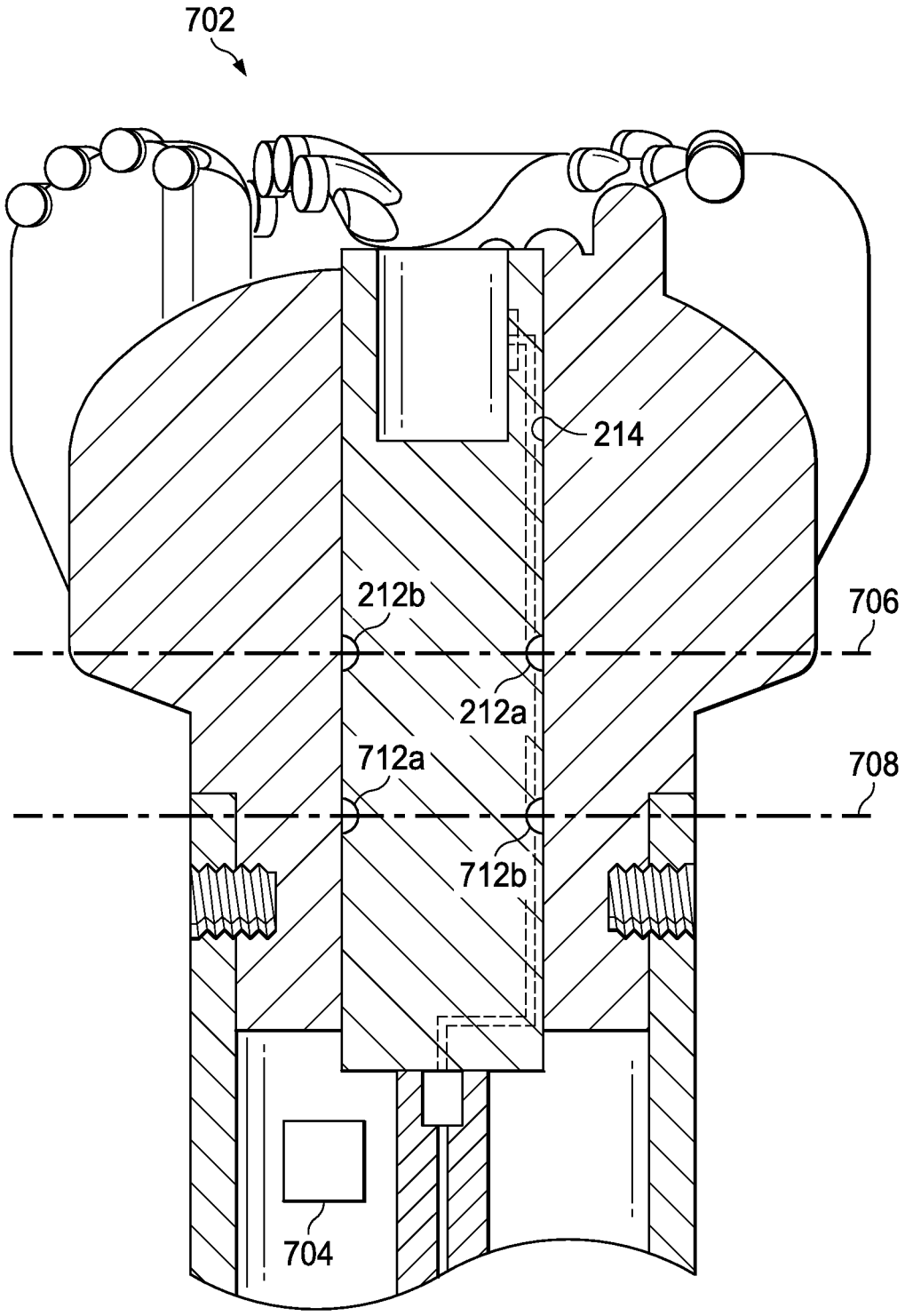
FIG. 7 is a schematic diagram of a drill bit assembly including multiple electrodes positioned on different circumferential planes.

FIG. 7 is a schematic diagram of a drill bit assembly 702 including multiple electrodes positioned on different circumferential planes. The drill bit assembly 702 includes four electrodes (for example, a first electrode 212*a*, a second electrode 212*b*, a third electrode 712*a*, a fourth electrode 712*b*). The first and second electrodes can be positioned on a first circumferential plane 706 and on an inner circumferential surface of the hollow portion of the drill bit. The third and fourth electrodes can be positioned on a second circumferential plane 708 and on the inner circumferential surface of the hollow portion of the drill bit. The drill bit assembly can include a remote controller 704 to control a timing of electrical discharge of the four electrodes. In some implementations, the controller 704 can control a pulse generator (such as the pulse generator 504) to cause the pairs of electrodes to discharge high voltage electricity in sequence. In some implementations, the drill bit assembly 702 can include additional pairs of electrodes disposed on additional circumferential planes based on a geometry of the hollow portion and available space to ensure adequate insulation.

For example, the multiple electrodes can be copper-tungsten electrodes held in the insulating insert inside the hollow portion of the drill bit. A copper-tungsten conductor can be set directly into the insert 502. The lower end of the conductor can be electrically connected to a rear of the high voltage electrode, for example, the third electrode 712*a* or the fourth electrode 712*b*. The upper end of the conductor can be terminated by a high voltage stab connector (number) to allow electrical connection to the high voltage output terminal of the pulse generator (number). The conductor can be insulated along its length by the ceramic sheath.

Figure 8:
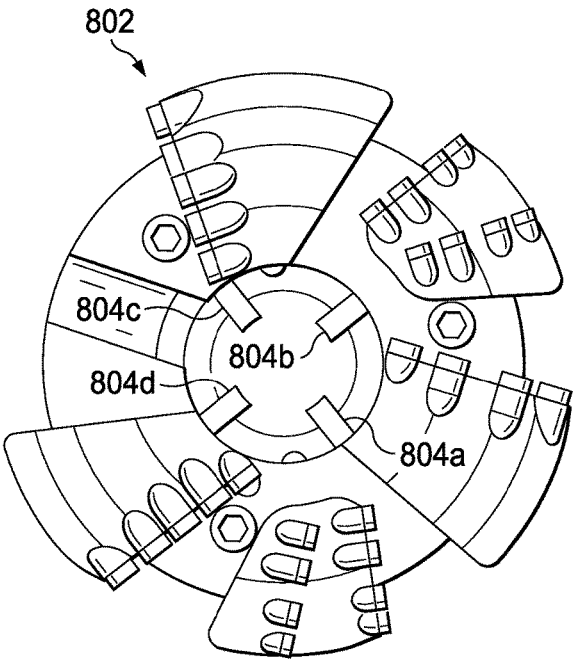
FIG. 8 is a schematic diagram of a drill bit assembly including cutters inside the hollow portion.

FIG. 8 is a schematic diagram of a drill bit assembly 802 including cutters inside the hollow portion. The drill bit assembly 802 can include one or more or all of the features of the drill bit assembly 102 or the drill bit assembly 602 or the drill bit assembly 702. In addition, the drill bit assembly 802 can include one or more cutters (for example, a first cutter 804*a*, a second cutter 804*b*, a third cutter 804*c*, a fourth cutter 804*d* or more or fewer cutters) at the second end within the hollow portion. Each of the one or more cutters can be substantially similar to one of the cutters 202*a*, 202*b*, 202*c*, 202*d* described above. That is, each of the one or more cutters can cut portions of rock in response to a rotary motion of the drill bit assembly 802. The cutters positioned in the hollow portion can be used to limit a height of the rock core. Alternatively or in addition, the cutters can be used to mechanically cut the rock core in the absence of electrical discharge from the electrodes, for example, if the electrodes fail.

Figure 9:
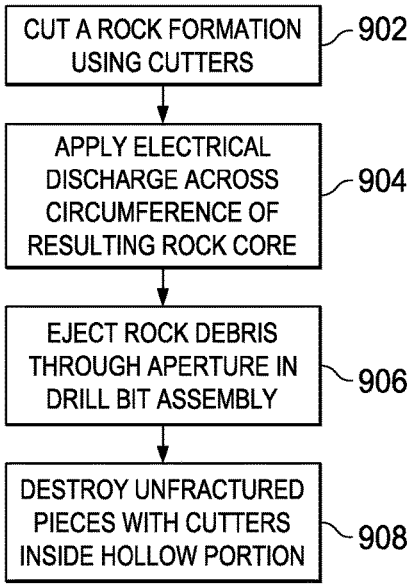
FIG. 9 is a flowchart of an example process for drilling a rock formation.

FIG. 9 is a flowchart of an example process 900 for drilling a rock formation. At 902, a rock formation can be cut using cutters. For example, the rock formation can be contacted by a front end of the drill bit assembly 102 that includes multiple cutters. A rotary motion of the drill bit assembly 102 against the rock formation can cut the rock formation and cause the rock core 104 to be formed within the hollow portion of the drill bit assembly 102. At 904, electrical discharge can be applied across the circumference of the resulting core. The electrodes positioned within the hollow portion can apply the electrical discharge across the body of the rock core, as opposed to a surface of the rock core, causing the rock core to fracture. At 906, rock debris can be ejected from side of the drill bit assembly through an aperture in the assembly. At 908, unfractured pieces can be destroyed with cutters inside the hollow portion of the assembly.

Thus, particular implementations of the subject matter have been described. Other implementations are within the scope of the following claims.

The invention claimed is:

1. A method comprising:

cutting a rock formation using cutters on a first end of a drill bit comprising a hollow portion that extends along a longitudinal axis of the drill bit from the first end towards a second end opposing the first end, a rock core protruding from the rock formation into the hollow portion in response to the cutting, the rock core comprising a circumferential surface;

applying electrical discharge across a plurality of locations on the circumferential surface of the rock core to fracture the rock core;

removing at least a portion of the fractured rock core from within the hollow portion through an aperture formed in the drill bit; and flowing at least a portion of drilling mud through the hollow portion to remove at least the portion of the fractured rock core through the aperture, wherein at least the portion of the drilling mud is flowed through a drilling mud nozzle positioned in the hollow portion at a location that is diametrically opposite a location of the aperture.

2. The method of claim 1, wherein a plurality of electrodes are attached at respective locations on an inner circumferential surface of the drill bit, and wherein applying the electrical discharge comprises applying the electrical discharge across at least two of the plurality of electrodes.

3. The method of claim 2, wherein the plurality of electrodes comprises a first electrode and a second electrode arranged on the inner circumferential surface of the drill bit, wherein the electrical discharge is applied between the first electrode and the second electrode.

4. The method of claim 3, wherein the first electrode and the second electrode are arranged diametrically opposite each other on opposing sides of the circumferential surface of the rock core.

5. The method of claim 3, wherein the plurality of electrodes comprises a third electrode and a fourth electrode arranged on the inner circumferential surface of the drill bit, wherein the electrical discharge is applied between the third electrode and the fourth electrode.

6. The method of claim 5, wherein the first, second, third and fourth electrodes are arranged on the same circumferential plane.

7. The method of claim 6, further comprising controlling a timing of the electrical discharge between the first electrode and the second electrode and the electrical discharge between the third electrode and the fourth electrode.

8. The method of claim 7, wherein the timing is controlled to apply the electrical discharge between the first electrode and the second electrode and the electrical discharge between the third electrode and the fourth electrode at different times.

9. The method of claim 2, wherein the first electrode and the second electrode are arranged on a first circumferential plane, and wherein the plurality of electrodes comprises a third electrode and a fourth electrode arranged on a second circumferential plane on the inner circumferential surface of the drill bit, the second circumferential plane separate from the first circumferential plane along the longitudinal axis of the drill bit.

10. The method of claim 2, wherein the circumferential surface of the rock core contacts discharging tips of the plurality of electrodes.

11. The method of claim 1, further comprising controlling a height of the rock core inside the hollow portion using cutters attached to a circumferential end surface of the hollow portion.

12. The method of claim 1, further comprising controlling an application of the electrical discharge across the two locations on the circumferential surface of the rock core based, in part, on a weight on the drill bit.

13. The method of claim 1, wherein cutting the rock formation using the cutters on the first end of the drill bit comprises rotating the drill bit and the cutters to cut the rock formation.

14. A drill bit assembly to cut a rock formation, the drill bit assembly comprising:

a drill bit comprising a hollow portion that extends along a longitudinal axis of the drill bit, the hollow portion extending from a first end to a second end opposing the first end;

cutters positioned on the first end, the cutters configured to cut the rock formation resulting in a rock core protruding from the rock formation into the hollow portion, the rock core comprising a circumferential surface;

a plurality of electrodes positioned within the hollow portion, the plurality of electrodes configured to apply electrical discharge across a plurality of locations on the circumferential surface of the rock core, the electrical discharge causing the rock core to fracture;

an aperture formed on a circumferential surface of the drill bit; and a drilling mud nozzle in the hollow portion, the drilling mud nozzle to flow drilling mud into the hollow portion to remove at least a portion of the fractured rock core from within the hollow portion, wherein the drilling mud nozzle is attached to an inner circumferential surface of the hollow portion at a location that is diametrically opposite a location of the aperture.

15. The drill bit assembly of claim 14, wherein the plurality of electrodes comprises a first electrode and a second electrode arranged on an inner circumferential surface of the drill bit, wherein the electrical discharge is applied between the first electrode and the second electrode.

16. The drill bit assembly of claim 15, wherein the first electrode and the second electrode are arranged diametrically opposite each other on opposing sides of the circumferential surface of the rock core.

17. The drill bit assembly of claim 15, wherein the plurality of electrodes comprises a third electrode and a fourth electrode arranged on the inner circumferential surface of the drill bit, wherein the electrical discharge is applied between the third electrode and the fourth electrode.

18. The drill bit assembly of claim 17, wherein the first, second, third and fourth electrodes are arranged on the same circumferential plane.

19. The drill bit assembly of claim 18, further comprising a controller comprising processing circuitry configured to control a timing of the electrical discharge between the first electrode and the second electrode and the electrical discharge between the third electrode and the fourth electrode.

20. The drill bit assembly of claim 19, wherein the controller is configured to control the timing to apply the electrical discharge between the first electrode and the second electrode and the electrical discharge between the third electrode and the fourth electrode at different times.

21. The drill bit assembly of claim 15, wherein the first electrode and the second electrode are arranged on a first circumferential plane, and wherein the plurality of electrodes comprises a third electrode and a fourth electrode arranged on a second circumferential plane on the inner circumferential surface of the drill bit, the second circumferential plane separate from the first circumferential plane along the longitudinal axis of the drill bit.

22. The drill bit assembly of claim 15, wherein the circumferential surface of the rock core contacts discharging tips of the pair of electrodes.

23. The drill bit assembly of claim 14, further comprising an insert configured to be positioned within and attached to the hollow portion, wherein the plurality of electrodes are configured to be attached to the insert.

24. The drill bit assembly of claim 23, wherein the insert is a ceramic insert.

25. The drill bit assembly of claim 23, wherein the insert comprises a slot that aligns with the hollow portion on the drill bit.

26. The drill bit assembly of claim 14, wherein the cutters include first cutters, and wherein the drill bit assembly further comprises second cutters positioned inside the hollow portion and attached to a circumferential end surface of the hollow portion.

27. The drill bit assembly of claim 14, wherein the drill bit and the cutters are configured to rotate to cut the rock formation resulting in a rock core protruding from the rock formation into the hollow portion.

* * * * *